US006308946B1

(12) United States Patent
Saitoh

(10) Patent No.: US 6,308,946 B1
(45) Date of Patent: Oct. 30, 2001

(54) IMAGE FORMING MACHINE WITH FOREIGN MATERIAL REMOVAL APPARATUS

(75) Inventor: Takeshi Saitoh, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/536,042

(22) Filed: Mar. 27, 2000

(30) Foreign Application Priority Data

Jan. 4, 1999 (JP) ..... 11-095026

(51) Int. Cl.[7] ..... B65H 5/22

(52) U.S. Cl. ..... 271/3.14; 271/3.15; 271/3.17; 271/4.02; 271/4.03; 271/157

(58) Field of Search ..... 271/3.14, 3.15, 271/3.17, 4.01, 4.02, 4.03, 110, 152, 157

(56) References Cited

U.S. PATENT DOCUMENTS 4,801,135 * 1/1989 Povio ..... 271/157 X 5,335,901 * 8/1994 Nonomura et al. ..... 271/157 X

* cited by examiner

*Primary Examiner*—David H. Bollinger
(74) *Attorney, Agent, or Firm*—Kanesaka & Takeuchi

(57) ABSTRACT

An image forming apparatus with a foreign material removal apparatus is formed of a sheet feeding table which is vertically movable and supports printing sheets thereon; a sheet feeding device for feeding the printing sheets stacked on-the sheet feeding table one by one; an image forming device for forming an image on the printing sheet fed by the sheet feeding means; a detecting device situated adjacent to the sheet feeding means and detecting the printing sheets fed by the sheet feeding device; and a foreign material removal device for removing foreign material covering the detecting device. The foreign material removal device includes a pump attached to the sheet feeding device and driven by vertical movements of the sheet feeding table to flow air, and a nozzle situated adjacent to the detecting device and attached to the pump. When the sheet feeding table moves vertically, the pump allows air to flow through the nozzle to remove the foreign material covering the detecting means.

6 Claims, 6 Drawing Sheets

IMAGE FORMING MACHINE WITH FOREIGN MATERIAL REMOVAL APPARATUS

BACKGROUND OF THE INVENTION

1. Field of the Invention

The present invention relates to a sensor used to detect a printing sheet in a image forming machine, especially to technology for preventing malfunction of the sensor covered by foreign material such as paper powder or dust.

2. Description of the Related Art

Generally, in an image forming machine such as a stencil printing machine, printing sheets are stacked on a predetermined position, and the sheets are picked up one by one and fed into an image forming section. Then, the sheet is discharged therefrom after an image is formed on the sheet. In such image forming machine, a sensor may be situated for obtaining a detection signal of the printing sheet to control timing of printing operation or to detect jamming of the printing sheet during printing operation.

For example, the printing sheet picked up from the predetermined position is conveyed by rollers through a conveying path composed of guiding plates, and then the sheet is detected by a light sensor of non contact type at a leading end thereof, so that it is judged whether conveying timing of the printing sheet is appropriate.

During the conveyance of the printing sheet by the rollers through the conveying path made of the guiding plates, the printing sheet produces much foreign material while being rubbed against edges of holes where the rollers are situated. Accordingly, as shown in FIG. 6(*a*), paper powder I accumulates on the light sensor of the non-contact type, thereby deteriorating detecting function of the sensor. To prevent this, a transparent cover may be attached onto the light sensor of the non-contact type; however, this is not actually adopted due to troublesome assembly operation needed by the complicated structure.

Further, as shown in FIG. 6(*b*), a light sensor of reflective type may be arranged downward above the conveying path to reduce accumulation of the foreign material. This structure requires periodic cleaning of a bottom surface of the sensor since the paper powder inevitably adheres thereto in a long term. Further, the problem arises from not only the paper powder, but also dust accumulated in a long term.

An object of the present invention is to simply and periodically clean a sensor that tends to be covered by paper powder or dust in an image forming machine having the sensor to detect a printing sheet.

SUMMARY OF THE INVENTION

An image forming machine with a foreign material removal apparatus as defined in a first aspect of the present invention comprises: a sheet feeding table which is vertically movable and supports printing sheets thereon; sheet feeding means situated adjacent to the sheet 25 feeding table and feeding the printing sheets stacked on the sheet feeding table one by one; image forming means situated near the sheet feeding means and forming an image on the printing sheet fed by the sheet feeding means; detecting means situated adjacent to the sheet feeding means and detecting the printing sheets fed by the sheet feeding means; and foreign material removal means situated adjacent to the detecting means and removing foreign material covering the detecting means by allowing air to flow thereto, the foreign material removal means being driven by vertical movement of the sheet feeding table.

An image forming machine with a foreign material removal apparatus as defined in a second aspect of the present invention comprises: a sheet feeding table which is vertically movable and supports printing sheets thereon; sheet feeding means situated adjacent to the sheet feeding table and feeding the printing sheets stacked on the sheet feeding table one by one as the sheet feeding table moves upward; detecting means situated adjacent to the sheet feeding means and detecting the printing sheets fed by the sheet feeding means; conveying means situated adjacent to the sheet feeding means and conveying the printing sheets fed by the sheet feeding means; image forming means situated near the conveying means for forming an image on the printing sheets fed by the sheet feeding means; foreign material removal means situated near the detecting means and removing foreign material covering the detecting means by allowing air to flow thereto, the foreign material removal means being driven by vertical movement of the sheet feeding table; and control means connected to the sheet feeding table to control downward movement of the sheet feeding table.

In an image forming machine with a foreign material removal apparatus according to a third aspect of the present invention, the image forming machine is formed according to the second aspect, wherein the detecting means is a first sensor for detecting the printing sheets conveyed just before the image forming means, and the control means drives the image forming means and the conveying means in synchronization with each other on the basis of a signal from the first sensor.

In an image forming machine with a foreign material removal apparatus according to a fourth aspect of the present invention, the image forming machine is formed according to the third aspect, wherein the image forming machine further comprises a sheet sensor for detecting whether the printing sheets are stacked on the sheet feeding table, the control means moving the sheet feeding table downward when the control means judges on the basis of a signal from the sheet sensor that the printing sheets are not stacked on the sheet feeding table.

In an image forming machine with a foreign material removal apparatus according to a fifth aspect of the present invention, the image forming machine is formed according to the third aspect, the image forming machine further comprises a discharge sensor for detecting a printing sheet discharged from the image forming means, on which an image is formed by the image forming means, the control means moving the sheet feeding table downward when the control means judges on the basis of a signal from the discharge sensor that a predetermined number of the printing sheets is printed.

In an image forming machine with a foreign material removal apparatus according to a sixth aspect of the present invention, the image forming machine is formed according to the fifth aspect, wherein the control means moves the sheet feeding table downward when the control means judges on the basis of difference of timing in detecting the printing sheet between the first sensor and the discharge sensor that jamming occurs in conveying the printing sheet.

BRIEF DESCRIPTION OF THE DRAWINGS

FIG. 6(*b*) is a view showing problems of the conventional image forming apparatus.

DETAILED DESCRIPTION OF PREFERRED EMBODIMENTS

Figure 1:
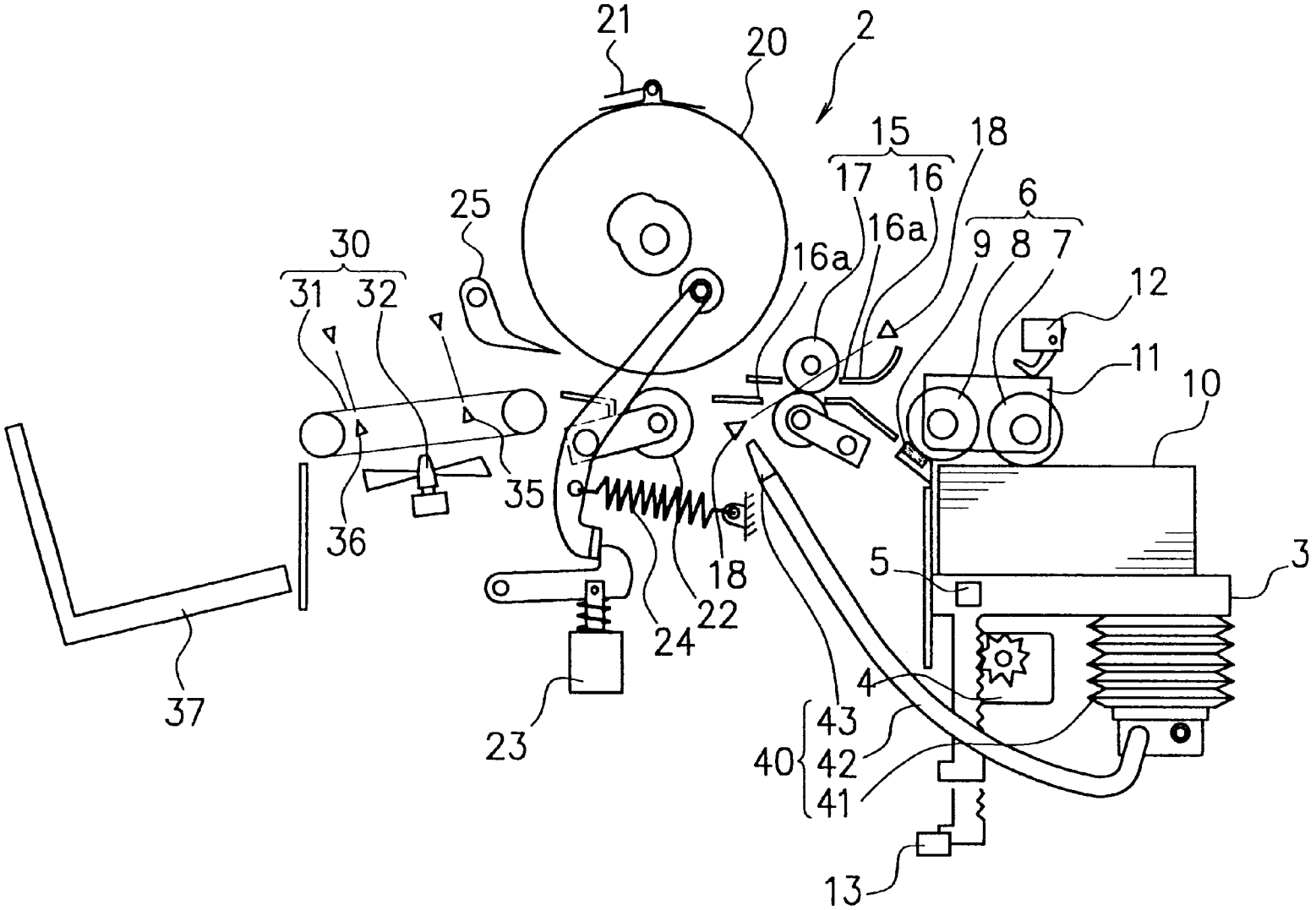
FIG. 1 is a sectional view showing a first embodiment of the present invention.

FIG. 1 is a schematic sectional view showing a stencil printing machine 2 as one example of an image forming machine.

In FIG. 1, a printing sheet is conveyed from the right side to the left side. A constitution of the present machine will be explained sequentially along the direction of the printing sheet.

The stencil printing machine 2 has a sheet feed table 3 where printing sheets are stacked. The sheet feed table 3 is moved vertically by a sheet feed table elevation motor 4. A sheet detection sensor 5 is situated on the sheet feed table 3 for detecting whether the printing sheet is stacked thereon.

Sheet feeding means 6 is situated above the sheet feed table 3. The sheet feeding means 6 has a scraper roller 7, a pick-up roller 8 and a separating plate 9. The scraper roller 7 takes out an uppermost printing sheet 10 from the stacked sheets. The pick-up roller 8 and the separating plate 9 separate the sheet 10 taken by the scraper roller 7 from other sheets and feed it out. The scraper roller 7 and the pick-up roller 8 are attached to a common casing 11 so that they are rotationally movable around a rotating axis of the pick-up roller 8.

An upper limit sensor 12 is situated above the casing 11. The upper limit sensor 12 detects a sheet feed position of an uppermost sheet of the printing sheets 10 stacked on the sheet feed table 3.

A lower limit sensor 13 is situated below the sheet feed table 3. The lower limit sensor 13 detects a lower limit position of the sheet feed table 3.

A plurality of the printing sheets 10 is stacked on the sheet feed table 3. The sheet feed table 3 moves upward, and the uppermost sheet 10 of the stacked sheets presses up the scraper roller 7. The casing rotationally moves upward around the axis of the pick up roller 8 together with the scraper roller 7, thereby operating the upper limit sensor 12. A signal from the upper limit sensor 12 stops the sheet feed table elevation motor 4. Thus, an upper limit position, i.e. the sheet feed position of the printing sheet 10 is determined, and then the scraper roller 7 and the pick-up roller 8 are driven.

First conveying means 15 is situated near the sheet feed table 3 for conveying the printing sheets 10 fed out by the sheet feeding means 6. The first conveying means 15 has a conveying path 16 for guiding the printing sheets 10 and conveying rollers 17 for conveying the printing sheets 10 between a printing drum 20 and a pressing roller 22 in a predetermined timing. The printing drum 20 and the pressing roller 22 will be explained later. The conveying path 16 is composed of a pair of plates arranged parallel to each other. The conveying rollers 17 are partially protruding inside the conveying path 16 through a roller hole 16*a* formed in the conveying path 16.

A sheet sensor 18 as a first sensor is situated near the conveying rollers 17. The sheet sensor 18 is a transmission type light sensor that includes a lower light-projection device and an upper light-reception device. The sheet sensor 18 detects a leading end of the printing sheet 10 fed by the sheet feed means 6 to reach the conveying rollers 17 of the first conveying means 15.

In printing, detection signal from the sheet sensor 18 initiates operation of image forming means, as explained later. The printing drum 20 as the image forming means is situated near the first conveying means 15. The printing drum 20 has an ink permeable circumferential wall. The printing drum 20 is rotatably supported on a central axis thereof and driven by not-shown driving means in a clockwise direction in the figure. Ink applying means is situated inside the printing drum 10 20 for applying ink to an inner circumferential surface of the circumferential wall. A clamp plate 12 is attached to an outer circumferential surface of the circumferential wall for holding a stencil sheet thereon. The perforated stencil sheet is wound around the circumferential wall with a leading end thereof held by the clamp plate 12. The pressing roller 22 is urged upward by a press spring 24 after being released by a pressing solenoid 23, thereby pressing the printing sheet 10 against the printing drum 20. Upon completion of operation of the pressing roller 22, the pressing roller 22 is restored to a position away from the printing drum 20 and held there.

A peeling claw 25 is situated adjacent to the printing drum 20. The peeling claw 25 is movable around an axis thereof The peeling claw 25 removes a leading end of the printing sheet 10 from the printing drum 20, which sheet is attached to the printing drum 20 after being printed. A second conveying means 30 is situated adjacent to the peeling claw 25. The second conveying means 30 has a conveying belt 31 and a suction fan 32. The printing sheet 10 is partially removed from the printing drum 20 by the peeling claw 25 at the leading end thereof, and is conveyed by the conveying belt 31 while being held thereon by suction of the suction fan 32, thus being peeled away from the printing drum 20.

A first discharge sensor 35 and a second discharge sensor 36 are situated adjacent to the conveying belt 31 of the second conveying means 30. The sensors are arranged in the conveying direction of the belt. Each sensor is of the transmission type that includes a lower light-projection device and an upper light-reception device. The first discharge sensor 35 detects a printed sheet 10 being discharged to the sheet discharging system. That is, the sensor 35 confirms that the printed sheet 10 is conveyed to the second conveying means 30 without rising over the belt. The second discharge sensor 36 detects the printed sheet 10 being discharged to a sheet discharge tray 37. That is, the sensor 36 confirms that the printed sheet 10 is appropriately conveyed by the second conveying means 30 before the sheet discharge tray 37.

The sheet discharge tray 37 is situated adjacent to the second conveying means 30. The printing sheets 10 are stacked on the sheet discharge tray 37 after being conveyed by the second conveying means 30.

In the stencil printing machine 2 thus constituted, paper powder tends to accumulate especially on the light-projection device situated lower in the sheet sensor 18. This is because the roller hole 16a is formed in the plates constituting the conveying path of the first conveying means 15 and the printing sheet 10 is scraped by edges of the roller hole 16*a* while being conveyed.

Then, in the present embodiment, foreign material removal means 40 is adopted for removing the paper powder accumulated on the light-projection device situated lower in the sheet sensor 18. Namely, an air pump 41 formed in a bellows-constitution is situated below the sheet feed table 3. An upper side of the air pump 41 is fixed to a lower surface of the sheet feed table 3. A bottom side of the air pump 41 is fixed to a not-shown frame of the present machine. An air hose 42 is connected to the air pump 41. An air nozzle 43 is attached to a forward end of the air hose 42. The air nozzle 43 is situated adjacent to the light-projection device situated lower in the sheet sensor 18.

Additionally, although the air pump is situated to a predetermined position and the upper side thereof is attached to the lower surface of the sheet feed table in this embodiment, the air pump may not be connected to the sheet feed table.

Figure 3:
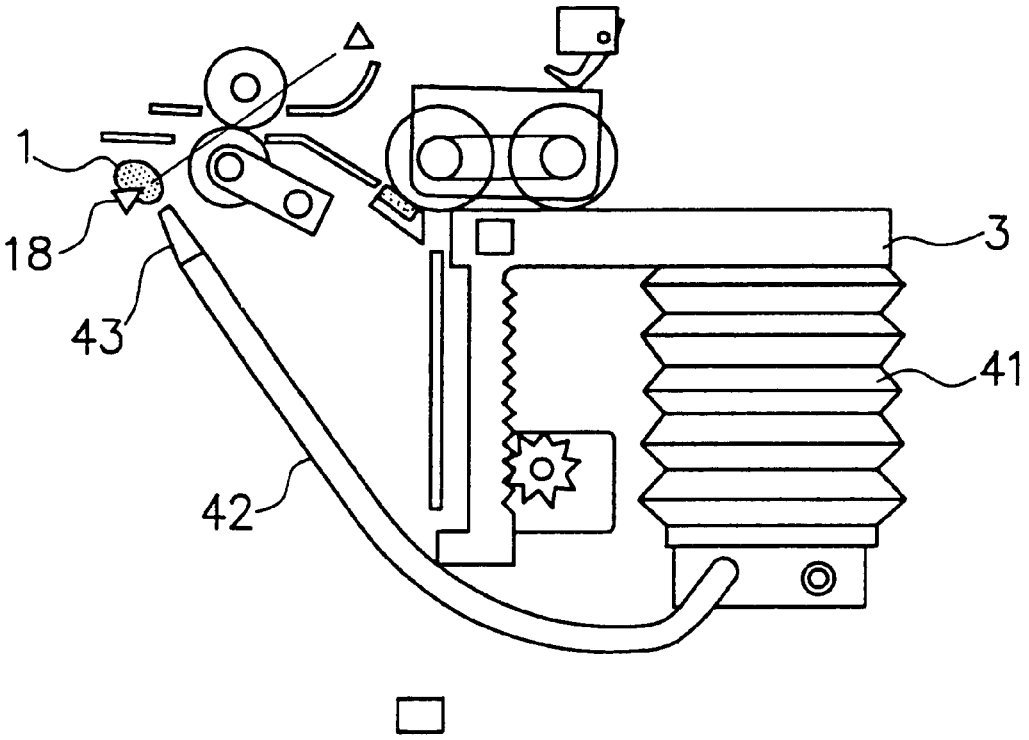
FIG. 3 is a view showing a sheet feeding table situated to an upper limit position or in the vicinity thereof in the first embodiment.
Figure 4:
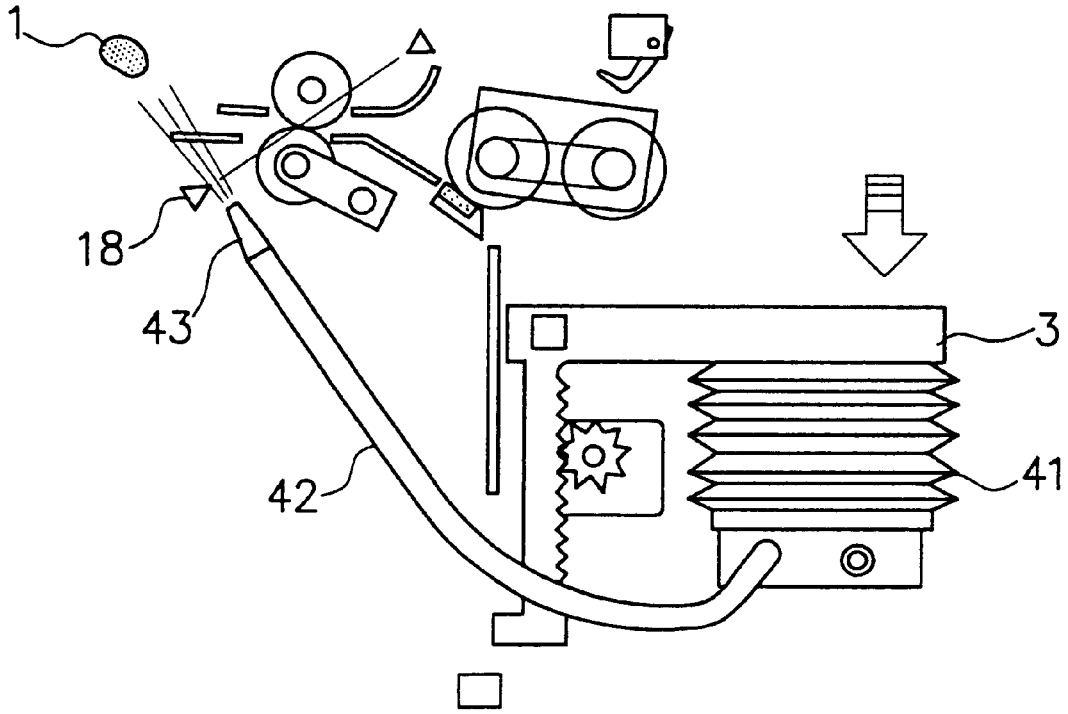
FIG. 4 is a view showing the sheet feeding table situated to a lower limit position or in the vicinity thereof in the first embodiment.

Accordingly, as shown in FIG. 3, the air pump 41 extends to increase a volume until the sheet feed table 3 moves upward to reach the upper limit position. As shown in FIG. 4, the air pump 41 contracts to decrease the volume while the sheet feed table 3 moves downward. The air pump 41 emits air through the air nozzle 43 while decreasing the volume, thereby blowing out the paper powder 1 accumulated on the sheet sensor 18.

Figure 2:
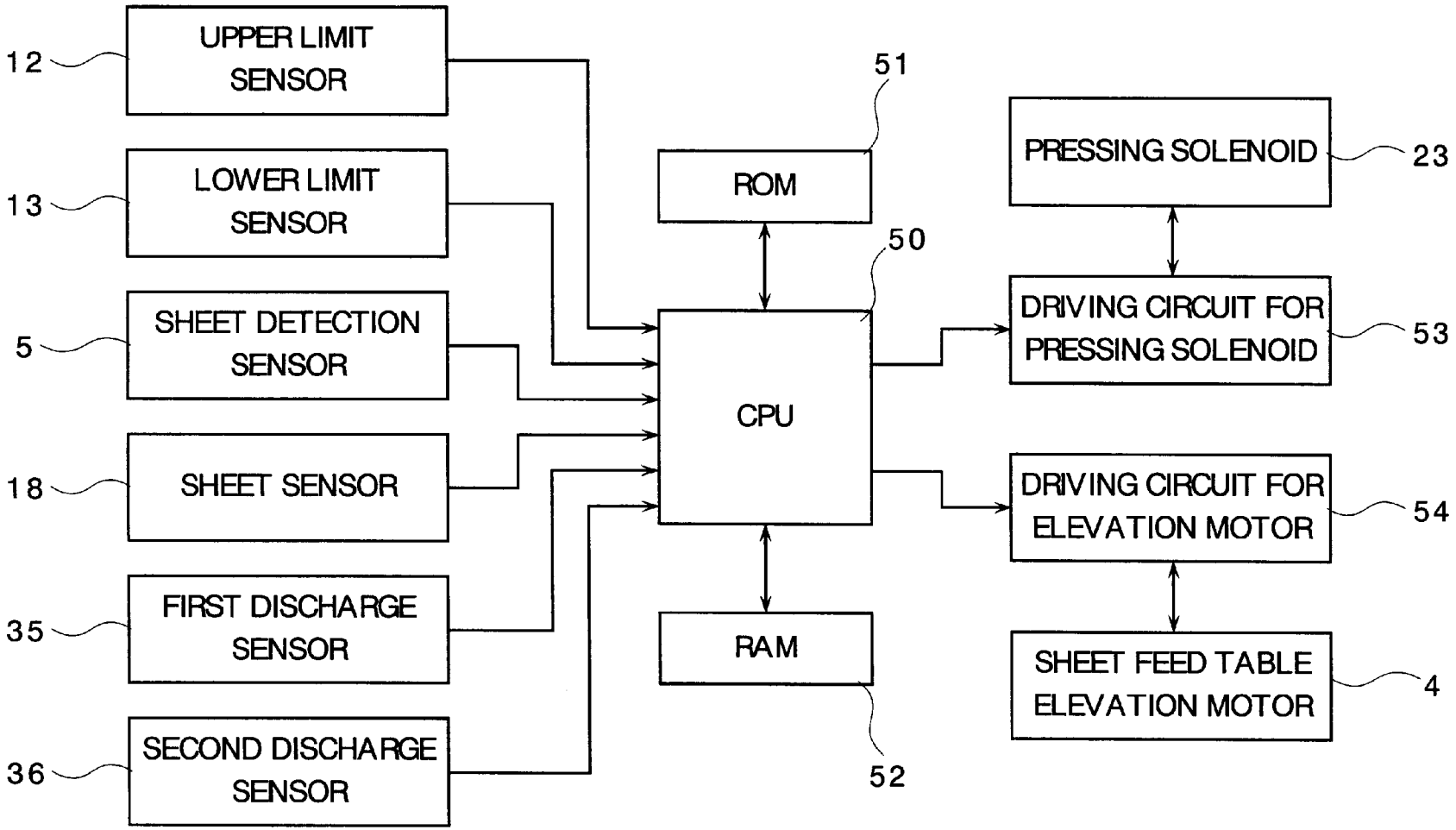
FIG. 2 is a block diagram showing a control system of the first embodiment.

FIG. 2 is a block diagram showing a control system of the present stencil printing machine 2.

A CPU 50 as control means has a ROM 51 for storing control programs of the present stencil printing machine 2 and a RAM 52 for storing data required for controlling the present stencil printing machine 2. The upper limit sensor 12, the lower limit sensor 13, the sheet detection sensor 5, the sheet sensor 18, the first discharge sensor 35, and the second discharge sensor 36 are connected to the CPU 50. The CPU 50 makes judgement on the basis of signals from these sensors to control the pressing solenoid 23 with a pressing solenoid driving circuit 53. Further, the CPU 50 makes judgement on the basis of signals from these sensors to control the sheet feed table elevation motor 4 with an elevation motor driving circuit 54.

Next, an operation of the present stencil printing machine 2 will be explained.

A plurality of the printing sheets 10 is stacked on the sheet feed table 3, and then printing operation is started. After the sheet detection sensor 5 detects the printing sheet 10 on the sheet feed table, the sheet feed table 3 moves upward until the upper limit sensor 12 functions. When the upper limit sensor 12 functions, the sheet feed table elevation motor 4 is stopped. Thus, the printing sheet 10 is positioned to the sheet feed position. Upon positioning the printing sheet 10, printing operation is started. Firstly, the sheet feed means 6 operates to take out the uppermost printing sheet 10. The printing sheet 10 passes through the conveying path 16 and hits against the conveying rollers 17 to stop there. After the sheet sensor 18 recognizes the printing sheet 10, the conveying rollers 17 start to rotate in synchronization with rotation of the printing drum 20, thereby supplying the printing sheet 10 to the printing drum 20. The pressing solenoid 23 operates in the same timing with operation of the conveying rollers 17, thereby pressing the printing sheet 10 against the printing drum 20. The printing sheet 10 is printed while being pinched and conveyed by the printing drum 20 and the press roller 22. The printing sheet 10 as printed is removed from the printing drum 20 by the peeling claw 25. The printing sheet 10 is conveyed by the second conveying means 30 and discharged onto the sheet discharge tray 37.

In the present stencil printing machine 2, the foreign material removal means 40 operates to blow out the paper powder 1 covering the sheet sensor 18 at every time when the sheet feed table 3 is lowered. Some cases in which the sheet feed table 3 is lowered will be explained.

When the printing sheets 10 on the sheet feed table 3 are used up completely, the CPU 50 allows the foreign material removal means 40 to operate by making the sheet feed table 3 to move downward.

The number of the printing sheets 10 on the sheet feed table 3 decreases as printing operation proceeds. The sheet feeding means 6 can feed out the printing sheet 10 at the predetermined sheet feed position since the sheet feed table 3 is moved upward according to the decrease of the printing sheet. If the sheet detection sensor 5 detects absence of the printing sheet 10, the CPU 50 allows the sheet feed table elevation motor 4 to rotate reversely so that the sheet feed table 3 is lowered. Lowering of the sheet feed table 3 makes the air pump 41 to be compressed, so that air is ejected from the air nozzle 43 toward the light-projection device situated lower in the sheet sensor 18. The paper powder 1 accumulated on the light-projection device is blew out and removed therefrom.

When a predetermined number of the printing sheets is printed, the CPU 50 allows the sheet feed table 3 to be lowered, so that the foreign material removal means 40 functions.

The CPU 50 counts the number of the printed sheets 10 on the basis of the signal from the first discharge sensor 35. When the number counted by the CPU reaches the predetermined number, the CPU 50 allows the sheet feed table 3 to be lowered, so that the foreign material removal means 40 functions.

When there arises a problem such as conveying failure of the printing sheet 10 during printing, the CPU 50 allows the sheet feed table 3 to be lowered, so that the foreign material removal means 40 functions.

The CPU 50 seizes conveying status of the printing sheet 10 through use of signals from the sheet sensor 18, the first discharge sensor 35, and the second discharge sensor 36. That is, the CPU 50 recognizes time required for the printing sheet 10 to pass through the sensors and compares the time with a standard time, thereby judging whether the conveying status of the printing sheet 10 is abnormal. If the time is judged to be abnormal, the CPU 50 allows the sheet feed table 3 to be lowered, so that the foreign material removal means 40 functions.

In using a printing machine such as the stencil printing machine 2, the problem of the foreign material accumulated on the sensor for detecting the printing sheet becomes critical after performing printing on some ten-thousands of the printing sheets. If the foreign material on the sensor is blown out by air whenever the sheet feed table is lowered, as is the case with the present stencil printing machine, the problem of the foreign material should be completely resolved.

In the present embodiment, the paper powder 1 on the sheet sensor 18 is blown out by air, whereas it is recommended that other air nozzles 43 be situated adjacent to other sensors, respectively. Further, air blowing is used to remove the foreign material in the present embodiment, whereas air sucking may be used. For example, an air-sucking device driven by lowering the sheet feed table 3 may be adopted and an air-inlet opening may be formed adjacent to the sensor.

Figure 5:
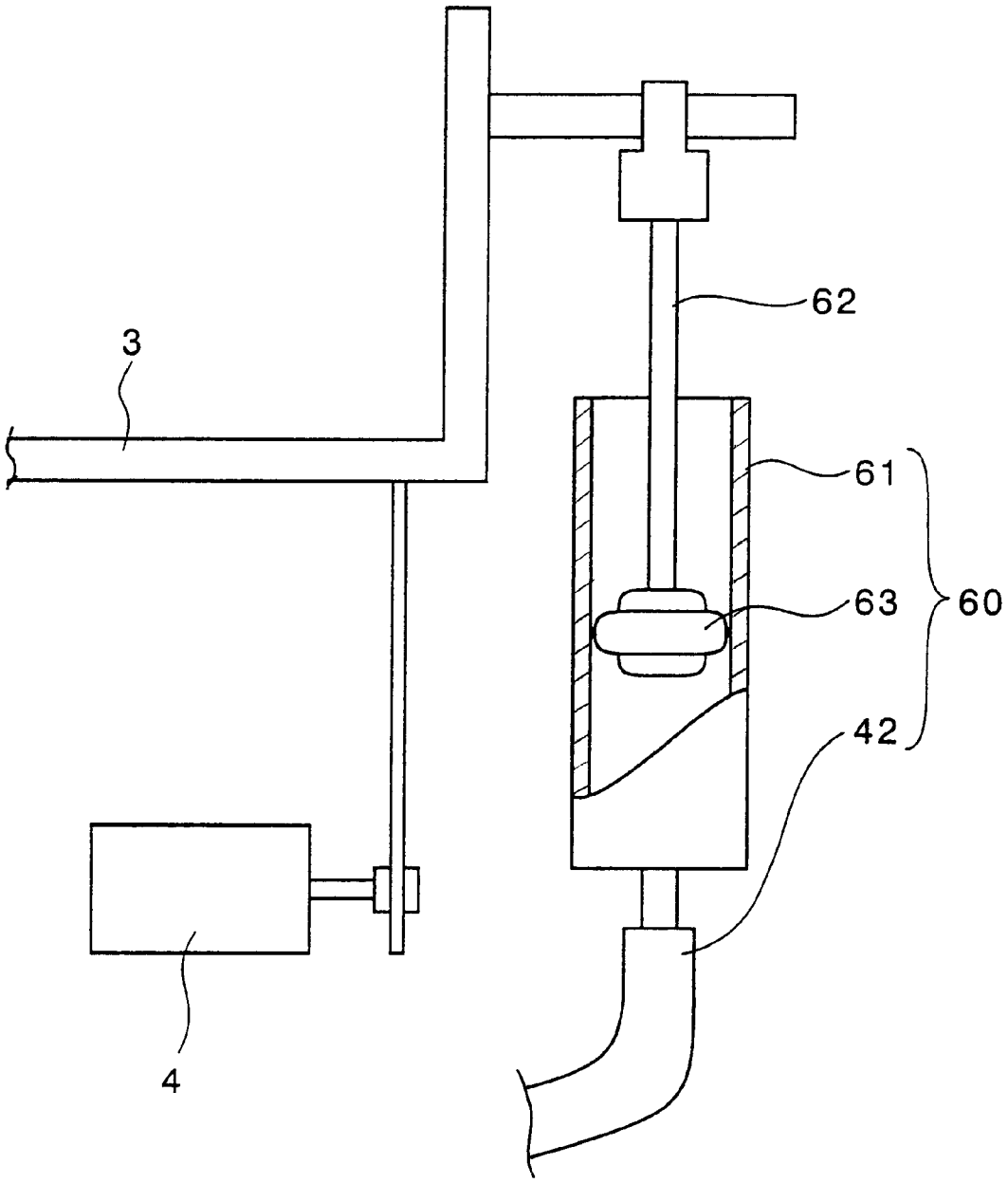
FIG. 5 is a sectional view showing a second embodiment of the present invention.
Figure 6A:
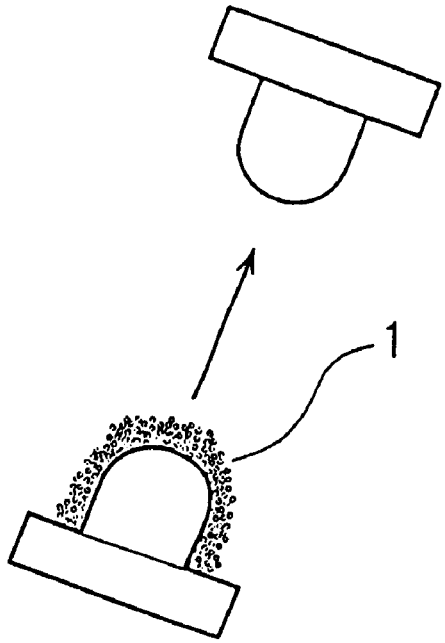
FIG. 6(a) PRIOR ART
FIG. 6(*a*) is a view showing problems of the conventional image forming apparatus.
Figure 6B:
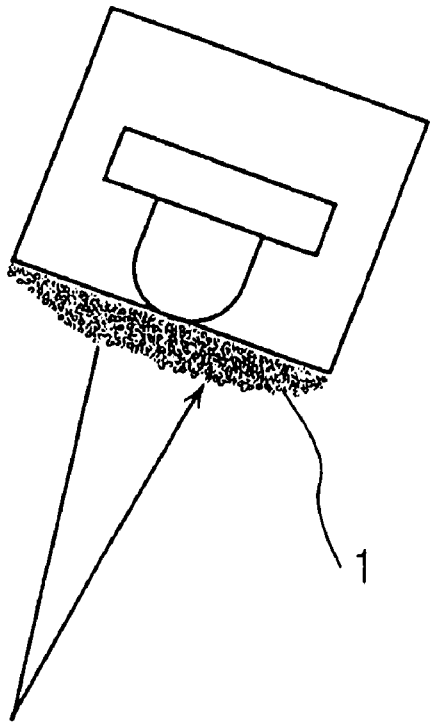
FIG. 6(b) PRIOR ART

FIG. 5 is a sectional view showing a primary part of a second embodiment. An air cylinder 61 is attached to the sheet feed table 3. The air cylinder serves as an air pump in a foreign material removal means 60. That is, a piston 63 is connected to the sheet feed table with a rod 62. The piston and the rod are directed downward. A cylinder 61 is fixed to a frame of the machine. The piston 63 is inserted inside the cylinder 63 to be slidable in an airtight contact therewith. An air outlet is formed on a bottom of the cylinder 61, and an air hose 42 is connected to the air outlet. A not shown air nozzle is attached to a forward end of the air hose 42. The air nozzle is situated adjacent to a sensor, similarly to the first embodiment. The present embodiment can also achieve the same effect as that of the first embodiment.

According to the present invention, in an image forming machine, foreign material removal means driven by vertical movement of a sheet feed table is adopted for blowing out sheet powder or dust covering a sensor. Accordingly, the image forming machine of the present invention can be structurally simplified since the foreign material removal means is not required to have dedicated power supply and driving means, and periodic cleaning of the sensor can be achieved if the machine is periodically operated.

What is claimed is:

1. An image forming machine with a foreign material removal apparatus comprising:

a sheet feeding table which is vertically movable and supports printing sheets thereon;

sheet feeding means situated adjacent to said sheet feeding table and feeding said printing sheets stacked on said sheet feeding table one by one;

image forming means situated near said sheet feeding means and forming an image on said printing sheet fed by said sheet feeding means;

detecting means situated adjacent to said sheet feeding means and detecting said printing sheets fed by said sheet feeding means; and foreign material removal means for removing foreign material covering said detecting means, said foreign material removal means including a pump attached to the sheet feeding means and driven by vertical movements of said sheet feeding table to flow air, and a nozzle situated adjacent to the detecting means and attached to the pump, said pump, when the sheet feeding table moves vertically, allowing air to flow through the nozzle to remove the foreign material covering the detecting means.

2. An image forming machine with a foreign material removal apparatus comprising:

a sheet feeding table which is vertically movable and supports printing sheets thereon;

sheet feeding means situated adjacent to said sheet feeding table and feeding said printing sheets stacked on said sheet feeding table one by one as said sheet feeding table moves upward;

detecting means situated adjacent to said sheet feeding means and detecting said printing sheets fed by said sheet feeding means;

conveying means situated adjacent to said sheet feeding means and conveying said printing sheets fed by said sheet feeding means;

image forming means situated near said conveying means for forming an image on said printing sheets fed by said sheet feeding means;

foreign material removal means for removing foreign material covering said detecting means, said foreign material removal means including a pump attached to the sheet feeding means and ejecting air by downward movement of said sheet feeding table, and a nozzle situated adjacent to the detecting means and attached to the pump so that when the pump is actuated, air is ejected through the nozzle to remove the foreign material covering the detecting means; and control means connected to said sheet feeding table to control the downward movement of said sheet feeding table.

3. A foreign material removal apparatus according to claim 2, wherein said detecting means is a first sensor for detecting said printing sheets conveyed just before said image forming means, and said control means drives said image forming means and said conveying means in synchronization with each other on the basis of a signal from said first sensor.

4. A foreign material removal apparatus according to claim 3, further comprising a sheet sensor for detecting whether said printing sheets are stacked on said sheet feeding table, said control means moving said sheet feeding table downward when the control means judges on the basis of a signal from said sheet sensor that said printing sheets are not stacked on said sheet feeding table.

5. A foreign material removal apparatus according to claim 3, further comprising a discharge sensor for detecting a printing sheet discharged from said image forming means, on which sheet an image is formed by said image forming means, said control means moving said sheet feeding table downward when the control means judges on the basis of a signal from said discharge sensor that a predetermined number of said printing sheets is printed.

6. A foreign material removal apparatus according to claim 5, wherein said control means moves said sheet feeding table downward when the control means judges on the basis of difference of timing in detecting said printing sheet between said first sensor and said discharge sensor that jamming occurs in conveying said printing sheet.

* * * * *